United States Patent [19]

Wirtz et al.

[11] Patent Number: 4,985,048

[45] Date of Patent: Jan. 15, 1991

[54] POLYMER MIXTURES FOR IMPROVING THE LOW-TEMPERATURE FLOW PROPERTIES OF MINERAL OIL DISTILLATES

[75] Inventors: Herbert Wirtz, Eppstein; Michael Feustel, Kelkheim; Juliane Balzer, Frankfurt am Main, all of Fed. Rep. of Germany

[73] Assignee: Hoechst Aktiengesellschaft, Frankfurt am Main, Fed. Rep. of Germany

[21] Appl. No.: 284,085

[22] Filed: Dec. 14, 1988

[30] Foreign Application Priority Data

Dec. 16, 1987 [DE] Fed. Rep. of Germany ..... 3742630

[51] Int. Cl.[5] ..... C10L 1/14; C10L 1/18

[52] U.S. Cl. ..... 44/394

[58] Field of Search ..... 44/62, 66, 70; 548/548

[56] References Cited

U.S. PATENT DOCUMENTS

| | | | |
|---|---|---|---|
| 3,661,541 | 5/1972 | Hollyday, Jr. | 44/62 |
| 3,762,888 | 10/1973 | Kober et al. | 44/62 |
| 3,803,034 | 4/1974 | Dasch | 44/62 |
| 3,961,916 | 6/1976 | Ilnyckyj et al. | 44/62 |
| 4,058,371 | 11/1977 | Ilnyckyj | 44/62 |
| 4,153,422 | 5/1979 | Wisotsky | 44/62 |
| 4,481,013 | 11/1984 | Tack et al. | 44/62 |
| 4,491,651 | 1/1985 | Naiman | 44/62 |
| 4,569,679 | 2/1986 | Rossi | 44/62 |
| 4,731,095 | 3/1988 | Garapon et al. | 44/62 |
| 4,746,327 | 5/1988 | Smyser | 44/62 |

*Primary Examiner*—Margaret B. Medley

[57] ABSTRACT

Polymer mixtures of a copolymer ($A_1$) made from 10–60% by weight of vinyl acetate and 40–90% by weight of ethylene or a copolymer ($A_2$) made from 15–50% by weight of vinyl acetate, 0.5–20% by weight of $C_6$–$C_{24}$-α-olefin and 30–70% by weight of ethylene, and a copolymer (B) made from 10–90% by weight of $C_6$–$C_{24}$-α-olefin and 10–90% by weight of N-$C_6$–$C_{12}$-alkylmaleiimide, the mixing ratio of copolymers ($A_1$) or ($A_2$) to (B) being 100:1 to 1:1. These polymer mixtures are employed as flow improvers in mineral oil distillates.

5 Claims, No Drawings

POLYMER MIXTURES FOR IMPROVING THE LOW-TEMPERATURE FLOW PROPERTIES OF MINERAL OIL DISTILLATES

Mineral oil distillates such as diesel fuel or heating oil contain various amounts of long-chain n-paraffins, depending on the origin of the crude oil on which they are based and depending on the processing procedure in the refinery. As has been known for some time, the flow behavior of such petroleum products at low temperatures is influenced principally by this content of n-paraffins. Such n-paraffins crystallize in the orthorhombic crystal lattice in the form of thin trapezoidal or rhombic platelets and thin needles when the temperature falls below the saturation point. In addition, these crystal modifications tend to grow into one another and agglomerate to form a three-dimensional network. Crystallization of the n-paraffin is accompanied by decrease in flowability and an increase in viscosity. As a consequence, filter blockages may occur in diesel engines and furnaces, impairing reliable metering of the fuel and, in the worst case, completely cutting off the supply of the fuel.

In most cases, the outlined problem of filter blocking by n-paraffins can be counteracted by using so-called flow improvers. The adducts formed between the n-paraffins and the flow improvers make friction-free operation of diesel engines and fuel systems possible even at low temperatures. As additives or flow improvers of this type, primarily copolymers of ethylene and vinyl acetate (EVA copolymers) in various variations are employed to improve the low-temperature stability of diesel fuels and heating oil.

However, middle distillate cuts in which these standard additives fail to work are now appearing to an increasing extent. This category includes, inter alia, middle distillates having a high final boiling point (FBP>380° C.). It is not unusual for the cloud point (CP) of such oils to be significantly above ±0° C.

Evaluation of the patent literature shows that attempts are being made, by means of additives to the above-mentioned ethylene-vinyl acetate copolymers, to increase the activity so as to master even critical oils of this type.

Thus, for example, mixtures of EVA copolymers having different molecular weights and different vinyl acetate contents are described (German Offenlegungsschrift No. 2,206,719). Furthermore, additives of polymeric substances of different compositions, such as polyacrylates (U.S. Pat. No. 4,058,371, German Offenlegungsschrift No. 2,613,316), ethylene-α-olefin copolymers (Belgian Patent No. 749,254) and esters of stearyl alcohols (French Patent No. 2,114,718) have been disclosed. The use of products of the reaction α-olefins, acrylates and maleic acid derivatives with amines has likewise been disclosed.

However, the inhibiting action of these products is not adequate, and precipitation of paraffins therefore occurs, in particular at low temperatures. It is also disadvantageous that the applicability of certain known additives is limited to only certain middle distillates.

It has now been found that the low temperature flow properties of middle distillates can be significantly improved by the polymer mixtures described below.

The invention relates to polymer mixtures comprising a copolymer ($A_1$) made from 10–60% by weight of vinylacetate and 40–90% by weight of ethylene or a copolymer ($A_2$) made from 15–50% by weight of vinyl acetate, 0.5–20% by weight of $C_6$–$C_{24}$-α-olefin and 30–70% by weight of ethylene, and a copolymer (B) made from 10–90% by weight of $C_6$–$C_{24}$-α-olefin and 10–90% of N-$C_6$–$C_{22}$-alkylmaleimide the mixing ratio of copolymers ($A_1$) or ($A_2$) to (B) being 100:1 to 1:1.

The copolymers mentioned under $A_1$ and $A_2$ are obtained by processes known per se via a high-pressure synthesis (reaction pressure: 100–200 MPa; reaction temperature: 120°–280° C.) in a bulk polymerization. As polymer ($A_1$), those are preferred which contain 15–40% by weight of vinyl acetate and, accordingly, 60–85% by weight of ethylene. The polymer ($A_2$) preferably contains 20–30% by weight of vinyl acetate and 2 to 5% by weight of α-olefin. Some polymers of this type are described in German Patent No. 2,102,469 and are prepared by the processes described therein.

The copolymers (B) preferably contain 50% by weight of the α-olefin and 50% by weight of the —N-alkylmaleiimide. The α-olefins preferably contain 8–18 carbon atoms, and the alkyl group in the —N-alkylmaleiimides preferably contains 12–22 carbon atoms. The copolymers mentioned (B) are obtained by solution polymerization of —N-alkylmaleiimides and α-olefins at 120° C. using typical free-radical initiators such as tert-butyl perbenzoate or azobisisobutyronitrile. The monomeric maleimide is previously obtained by stoichiometric reaction of maleic anhydride and the appropriate amine at 120°–150° C. using an aromatic hydrocarbon, such as, for example, toluene or xylene, as entrainer and p-toluenesulfonic acid as catalyst. The progress of the reaction can be determined by means of the acid number.

The α-olefin and the free-radical catalyst are then added to this solution, and the polymerization is carried out by heating to approximately 100°–140° C. However, it is also possible to carry out this polymerization in the melt without solvent, in which case the solvent, which was required for the preparation of the —N-alkylmaleiimide, is removed by distillation before the polymerization.

The mean molecular weight of all three copolymers is about 1,000 to 10,000 g $mol^{-1}$. The mixing ratio of polymers ($A_1$) or ($A_2$) to (B) is 100:1 to 1:1, preferably 10:1 to 6:1 parts by weight.

The polymer mixtures according to the invention are prepared by simply mixing the individual components.

The polymer mixtures described are distinguished by a very broad activity and also make it possible to improve the low-temperature properties of the problem oils mentioned in the introduction. The polymer mixtures are added to the petroleum distillates in amounts of from about 10 to 500 ppm.

I. PREPARATION OF THE N-ALKYLMALEIMIDES

EXAMPLE 1

98 g (1 mol) of maleic anhydride and 0.35 g of p-toluenesulfonic acid are dissolved in 100 g of toluene at 50° C. in a 1 liter 4-necked flask fitted with stirrer, internal thermometer and water separator. 101 g (1 mol) of n-hexylamine are slowly added dropwise at a rate such that the temperature can be kept between 80° C. and 90° C. When the exothermic reaction has subsided, the internal temperature is increased to 120° C. A total of 8 to 12 g of water are removed over the course of 6 hours. The internal temperature during this reaction is 120° C.

at the beginning and 140° C. at the end. A pale brown solution having the acid number 20 is obtained.

EXAMPLE 2

Analogously to Example 1, 325 g (1 mol) of melted docosylamine are added to 98 g (1 mol) of maleic anhydride. This process gives a brown paste having the acid number 50.

EXAMPLE 3

Analogously to Example 1, 270 g (1 mol) of melted stearylamine are added to 98 g (1 mol) of maleic anhydride. This process gives a brown paste having the acid number 30.

II. PREPARATION OF THE N-ALKYLMALEIMIDE/α-OLEFIN-COPOLYMER

EXAMPLE 1

200 g of the solution prepared in accordance with I.1 together with 200 g of 1-hexene are introduced to a 1 liter 4-necked flask fitted with a stirrer matched to the contours of the wall, reflux condenser, contact thermometer and dropping funnel. The mixture is heated to 100° C., and a solution of 2 g of AIBN (azobisisobutyronitrile) in 40 g of toluene is added dropwise over the course of 20 minutes. When the addition is complete, the temperature is held at 120° C. for a further 2 hours.

EXAMPLE 2

In accordance with the procedure given in Example II.1, 200 g of the solution prepared in accordance with example I.2 are initially introduced together with 200 g of a mixture of $C_{20}$-, $C_{22}$- and $C_{24}$-α-olefin and heated to 120° C. A mixture of 2 g of t-butylbenzoyl peroxide in 40 g of toluene is added dropwise over the course of 20 minutes, and the temperature is then held at 140° C. for a further 2 hours.

EXAMPLE 3

200 g of the imide of Example I.2, freed from toluene, are heated to 120° C. together with 200 g of 1-octadecene. 2 g of t-butylbenzoyl peroxide are added in small portions to this mixture. When the exothermic reaction has subsided, a red-brown copolymer is obtained. The K value (25° C./5% in toluene) is in all cases between 10 and 15.

EXAMPLE 4

In accordance with the procedure given in Example II.1, 200 g of the solution prepared in accordance with Example I.3 are initially introduced together with 200 g of $C_{18}$-α-olefin (octadecene) and heated to 120° C. A mixture of 2 g of AIBN in 40 g of toluene is added dropwise over the course of 20 minutes, and the temperature is then held at 120° C. for a further 2 hours.

USE EXAMPLES

The CFPP (Cold Filter Plugging Point) test has proven successful as a standardized test method. In this test, the CFPP (determined in accordance with DIN 51428) denotes the limiting value of filterability. All measurements were carried out on a Herzog MC 840-D6 CFPP instrument.

The following polymers were tested:

A: Mixture of 6 parts by weight of an ethylene-vinyl acetate copolymer, vinyl acetate content 26.5% by weight; molecular weight 1,000–4,000 g $mol^{-1}$, and 1 part by weight of a copolymer made from 50% by weight of 1-octadecene and 50% by weight of —N-stearylmaleiimide.

B: Mixture of 10 parts by weight of the ethylene-vinyl acetate copolymer as under A and 1 part of the 1-octadecene/stearylmaleimide as under A.

C: Mixture of 6 parts by weight of a terpolymer made from 69% by weight of ethylene, 26% by weight of vinyl acetate and 5% by weight of di-isobutylene, and 1 part by weight of a copolymer made from 50% by weight of 1-octadecene and 50% by weight of —N-stearylmaleimide.

D: Ethylene-vinyl acetate copolymer as under A. Vinyl acetate content 26.5% by weight.

E: Terpolymer as indicated under C; 69% of ethylene, 26% of vinyl acetate and 5% of di-isobutylene.

F: Ethylene-vinyl acetate copolymer having a vinyl acetate content of 26.4% by weight and a solids content of 57.3% by weight.

G: Ethylene-vinyl acetate copolymer having a solids content of 50% by weight.

H: Ethylene-vinyl acetate copolymer having a vinyl acetate content of 26.4% by weight and a solids content of 65.7% by weight.

I: Ethylene-vinyl propionate copolymer.

J: Ethylene-vinyl acetate-2-olefin terpolymer, mixed with wax oxidates.

The results given in the table below clearly show that the best results regarding the low-temperature flow properties of mineral oil distillates are obtained when the mineral oil distillates according to the invention are used.

TABLE

| | CFPP response behavior | | | | | | | | | | |
|---|---|---|---|---|---|---|---|---|---|---|---|
| Middle dist. | A | B | C | D | E | F | G | H | I | J | Added amount (ppm) |
| Heating oil<br>CFPP: −1° C.<br>IBP: 165° C.<br>FBP: 381° C. | −15 | −19 | −3 | −5 | 0 | | | | | −1 | 150 |
| Gas oil<br>CP: +2° C.<br>CFPP: −2° C. | −18 | −17 | −15 | −8 | −7 | −8 | −9 | | | −9 | 600 |
| Gas oil<br>CP: +2° C.<br>CFPP: −4° C. | −20 | −20 | −18 | −6 | −7 | | −10 | | | −7 | 600 |
| Heating oil<br>CP: +4° C.<br>CFPP: +2° C. | −15 | −13 | −15 | −11 | −3 | | | −13 | | −4 | 300 |
| Diesel fuel<br>CP: +4° C. | −14 | −14 | −11 | −3 | −2 | | | | −1 | −4 | 300 |

TABLE-continued

| Middle dist. | A | B | C | D | E | F | G | H | I | J | Added amount (ppm) |
|---|---|---|---|---|---|---|---|---|---|---|---|
| | CFPP response behavior | | | | | | | | | | |
| CFPP: 0° C. | | | | | | | | | | | |
| IBP: 168° C. | | | | | | | | | | | |
| FBP: 400° C. | | | | | | | | | | | |
| Gas oil | −7 | −6 | −3 | +7 | +7 | +6 | | | | +6 | 1,000 |
| CP: +10° C. | | | | | | | | | | | |
| CFPP: +8° C. | | | | | | | | | | | |
| Heating oil | −8 | −11 | +2 | −6 | +2 | | | | | +2 | 100 |
| CP: +5° C. | | | −10 | | +1 | | | | | | 500 |
| CFPP | | | | | | | | | | | |
| Gas oil | −15 | −15 | −14 | −6 | −7 | −14 | | −11 | | −7 | 300 |
| CP: −1° C. | | | | | | | | | | | |
| CFPP: −4° C. | | | | | | | | | | | |

CP = Cloud point; CFPP = Cold Filter Plugging Point
IBP = Initial Boiling Point; FBP = Final Boiling Point

We claim:

1. A polymer mixture of a copolymer ($A_1$) made from 10–60% by weight of vinyl acetate and 40–90% by weight of ethylene or a copolymer ($A_2$) made from 15–50% by weight of vinyl acetate, 0.5–20% by weight of $C_6$–$C_{24}$-α-olefin and 30–70% by weight of ethylene, and a copolymer (B) made from 10–90% by weight of $C_6$–$C_{24}$-α-olefin and 10–90% by weight of —N-$C_6$–$C_{22}$-alkylmaleimide, the mixing ratio of copolymers ($A_1$) or ($A_2$) to (B) being 100:1 to 1:1.

2. A polymer mixture as claimed in claim 1, wherein the mixing ratio of copolymers ($A_1$) or ($A_2$) to (B) is 10:1 to 6:1.

3. A polymer mixture as claimed in claim 1, wherein the copolymer ($A_1$) contains 15 to 40% by weight of vinyl acetate, and the copolymer ($A_2$) contains 20 to 30% by weight of vinyl acetate and 2 to 5% by weight of α-olefin.

4. A polymer mixture as claimed in claim 1, wherein the copolymer (B) comprises 50% by weight of α-olefin and 50% by weight of N-alkylmaleimide.

5. Mineral oil distillates having improved flow properties containing a polymer mixture as claimed in claim 1.

* * * * *